US007311641B2

(12) United States Patent
Panagos

(10) Patent No.: US 7,311,641 B2
(45) Date of Patent: Dec. 25, 2007

(54) METHOD AND DEVICE FOR WEIGHTLIFTING AND WEIGHT TRAINING

(76) Inventor: George C. Panagos, P.O. Box 1151, Hilo, HI (US) 96721

( * ) Notice: Subject to any disclaimer, the term of this patent is extended or adjusted under 35 U.S.C. 154(b) by 1 day.

(21) Appl. No.: 11/205,731

(22) Filed: Aug. 16, 2005

(65) Prior Publication Data

US 2007/0042879 A1 Feb. 22, 2007

(51) Int. Cl.
*A63B 21/072* (2006.01)

(52) U.S. Cl. ..... 482/97; 482/98; 482/106; 482/107

(58) Field of Classification Search ..... 482/92–104, 482/50, 106–110, 45, 46, 140; D21/679, D21/681

See application file for complete search history.

(56) References Cited

U.S. PATENT DOCUMENTS

| | | | | | |
|---|---|---|---|---|---|
| 407,071 | A | * | 7/1889 | Hopkins | 601/113 |
| 3,094,324 | A | * | 6/1963 | Asa | 482/131 |
| 3,588,102 | A | | 6/1971 | Gifford | |
| 4,252,316 | A | * | 2/1981 | Price | 482/106 |
| 4,405,128 | A | * | 9/1983 | Mclaughlin et al. | 482/97 |
| 4,605,221 | A | * | 8/1986 | D'Agosta | 482/8 |
| 4,607,840 | A | * | 8/1986 | Harper | 482/109 |
| 4,830,361 | A | * | 5/1989 | Hoffman | 482/50 |
| 4,921,246 | A | * | 5/1990 | Hornbostel | 482/106 |
| 4,973,043 | A | | 11/1990 | Nolan | |
| 5,350,345 | A | | 9/1994 | Frey | |
| 5,393,284 | A | * | 2/1995 | Wesley | 482/106 |
| 5,496,240 | A | * | 3/1996 | Damm | 482/93 |
| 5,496,243 | A | | 3/1996 | Allen | |
| 5,536,227 | A | * | 7/1996 | Polchek et al. | 482/93 |
| 5,921,902 | A | | 7/1999 | Carpenter | |
| 5,967,948 | A | * | 10/1999 | Carr | 482/93 |
| 6,142,918 | A | * | 11/2000 | Liu | 482/108 |
| 6,196,951 | B1 | | 3/2001 | Sheperd | |
| 6,338,702 | B1 | | 1/2002 | Jordan | |
| 6,364,815 | B1 | * | 4/2002 | Lapcevic | 482/97 |
| 6,592,499 | B2 | * | 7/2003 | Parker | 482/106 |
| 6,991,591 | B1 | * | 1/2006 | Tsatsouline | 482/140 |
| 7,048,674 | B2 | * | 5/2006 | Hartman et al. | 482/46 |
| 7,137,930 | B1 | * | 11/2006 | Carr | 482/98 |
| 2004/0185989 | A1 | | 9/2004 | Emick | |

FOREIGN PATENT DOCUMENTS

| | | | |
|---|---|---|---|
| JP | 07255873 | A * | 10/1995 |
| JP | 2000093549 | A * | 4/2000 |
| JP | 2001299977 | A * | 10/2001 |

* cited by examiner

*Primary Examiner*—Kevin C. Sirmons
*Assistant Examiner*—Victor K. Hwang
(74) *Attorney, Agent, or Firm*—Leighton K. Chong

(57) ABSTRACT

An exercise device for weightlifting or weight training for use with resistance type weightlifting exercises. The device is a V-shaped, solid, weighted exercise bar with two wings and an apex. The wings contain handle grips and are capable of having weight plates, discs and collars attached. The apex contains a projecting post that extends in an outward direction and holds weight, whereby the weight balances and counterbalances the weight on the wings. The total weight on the apex can be heavier, lighter or equal to the total weight on the wings. In a preferred embodiment of the invention, the apex and wings are capable of accepting standard weight plates and discs using conventional weightlifting collars to hold the weights in place. In an alternative embodiment the apex and wings are permanently set with weights. Included are corresponding weight training methods for use with the exercise device.

10 Claims, 3 Drawing Sheets

METHOD AND DEVICE FOR WEIGHTLIFTING AND WEIGHT TRAINING

BACKGROUND OF INVENTION

1. Field of Invention

The present invention relates to an exercise device and method for weightlifting and weight training, and more particularly to solid, weighted, "V"-shaped exercise bars, as well as corresponding weight training methods using the exercise device.

2. Description of the Prior Art

Conventional dumbbells and barbells are used for a wide range of resistance-type and weight training and weightlifting exercises. For example, the inventor has patented an invention for interlocking dumbbells. See U.S. Pat. Nos. 5,171,199 and 5,131,898. However, because of conventional dumbbells and barbells' universal nature, they are limited in their effectiveness to isolate certain muscles of the body. There are a variety of V-shaped apparatuses that have been proposed to address some of these limitations. However, these V-shaped apparatuses are bulky and unwieldy, are not balanced properly, and limit the handle grip and range of motion of the weightlifter. A further disadvantage of these apparatuses is that it often requires the attachment of conventional dumbbells, or needs to be used in association with a universal pulley machine which requires cables, pulleys and levers.

It is an object of the present invention to allow the weightlifter or weight trainer to use a V-shaped exercise bar that eliminates the need for cables, pulleys and levers associated with universal pulley machines, and provide the user with an option to increase the weight of the V-shaped exercise bar through the addition of standard weight plates and discs instead of entire dumbbells. It is a further object of the present invention to provide the user with more flexibility in terms of handle gripping, balance and range of motion, and decrease the bulk inherent in the prior art inventions.

BRIEF SUMMARY OF THE INVENTION

The foregoing and other objects are achieved in accordance with the present invention, a novel method and device for weightlifting and weight training incorporating a weighted V-shaped exercise bar. The device of the present invention is a solid, weighted exercise bar with two wings and an apex—its shape is similar to that of a "V". The wings contain handle grips and are capable of having weight plates, discs and collars attached. The apex contains a projecting post that extends in an outward direction and holds an adjustable weight, thereby allowing the user to balance and counter balance the weight on the wings for various exercises. The total weight on the apex can be heavier, lighter or equal to the total weight on the wings. This allows the user flexibility and comfort in performing various weightlifting exercises. In addition, the control of the weight balance causes changes in the working mass of the human body plus the device and weights during use of the device, which effects the velocity and momentum of the device when doing the weight training method, and results in a more efficient workout performance for the weightlifter.

In a preferred embodiment of the invention, the apex is capable of having standard weight plate(s) and disc(s) attached to it using a weightlifting collar to hold the weight in place. In an alternative embodiment the apex is permanently set with weight. The wings can also be weighted by attaching standard weight plates and collars or by having weights permanently affixed to them.

Included are corresponding weight training methods for use with the exercise device. The first step of the method is for the user to stand between the wings of the invention with the apex pointing forward or in the direction of the user's feet. After bending down to grip the invention by the handle grips, the user stands with arms to the side and the invention around the weightlifters hips and stomach. The user is now in the start position. At the start position, the weightlifter extends his or her arms outward and forward without bending the elbows. When the weightlifter raises the invention above his or her head, the weightlifter then lowers the invention back to the start position. The user repeats this exercise as desired.

In an alternative method of the invention, the weightlifter first steps inside of the wings of the device with the apex pointed toward the rear or opposite the direction of the weightlifter's feet. The weightlifter then bends down to grip the handle grips. The weightlifter then stands straight up with arms to the side and the device around the hips and lower back, as if holding a belt around the waist. The weightlifter is now in the start position. In the start position, the weightlifter performs a squat until his or her thighs are parallel with the ground. The weightlifter then stands back up to the start position. This alternative method can be repeated as desired by the weightlifter.

These methods can be modified by the user to suit the weightlifter's individual needs and desires. Other resistance-type exercises that can be performed using conventional dumbbells and barbells are possible and contemplated by the inventor.

The novel device and method of the present invention facilitates the efficient training of the weightlifter's muscles without the bulk, cables, pulleys, levers, and range of motion limitations. Further objects and advantages of this invention will become apparent from consideration of the drawings and ensuing description.

DETAILED DESCRIPTION OF THE PREFERRED EMBODIMENTS

Figure 1:
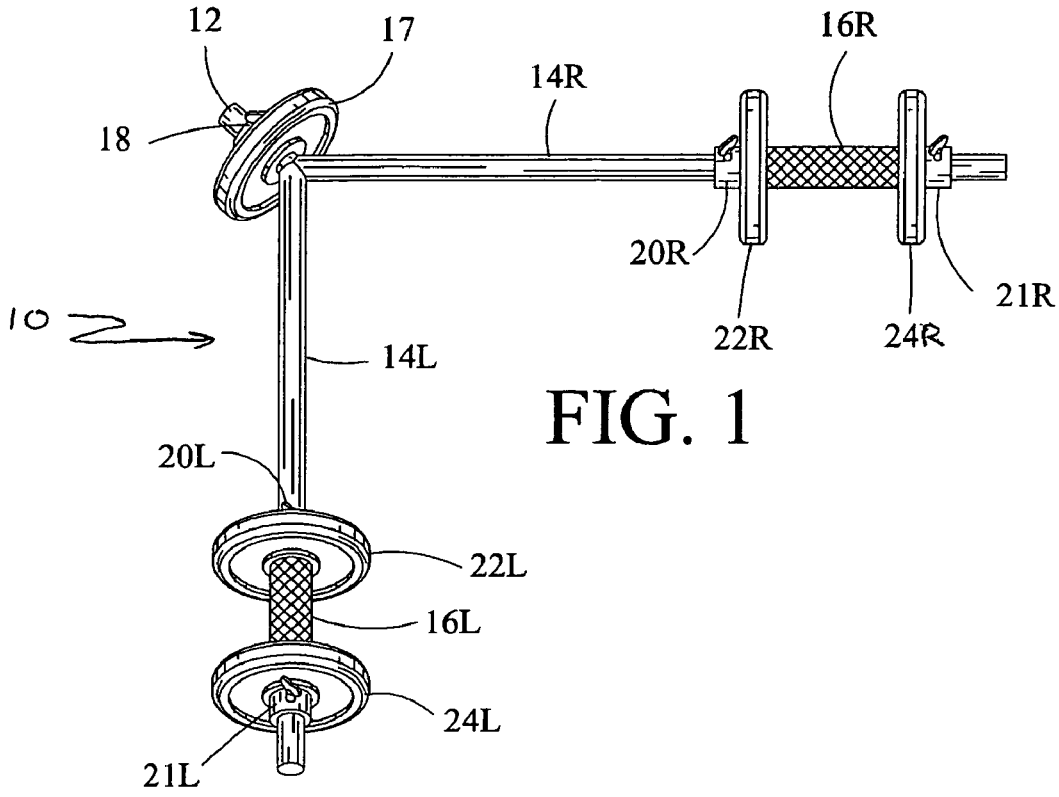
FIG. 1 is a front perspective view of a preferred embodiment of the novel exercise device, showing the location of the handle grips, weight collars and standard weight plates or discs.
Figure 2:
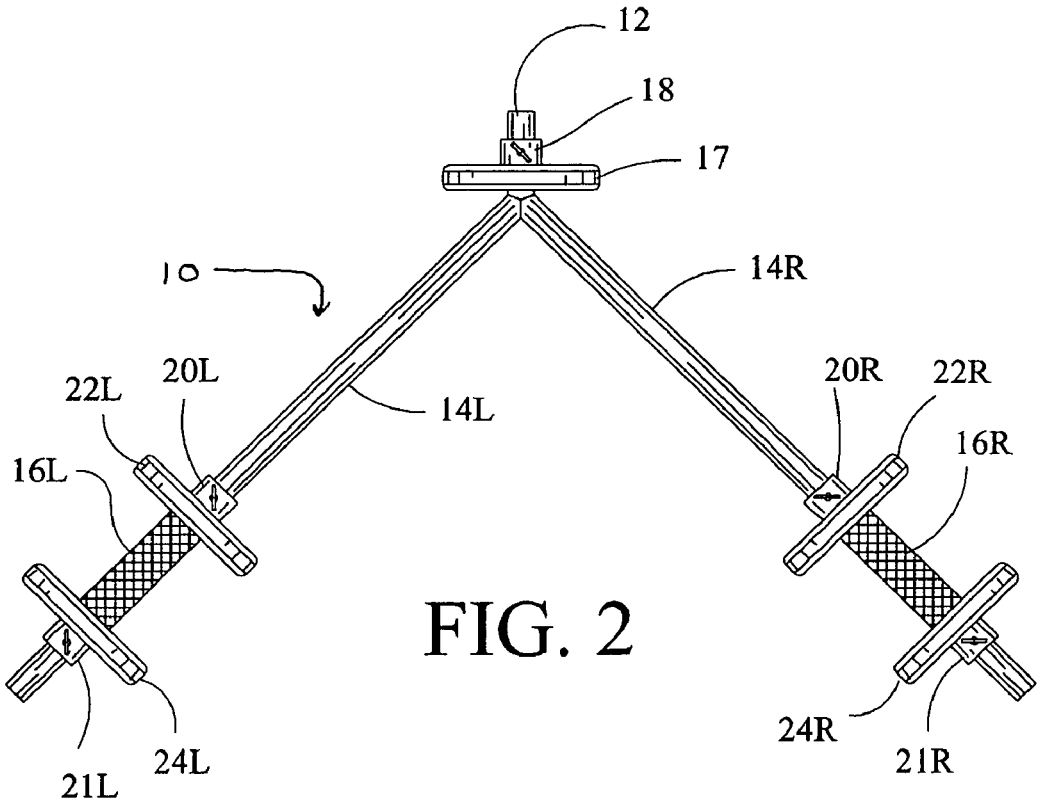
FIG. 2 is a front view of the preferred embodiment of the present invention.
Figure 3:
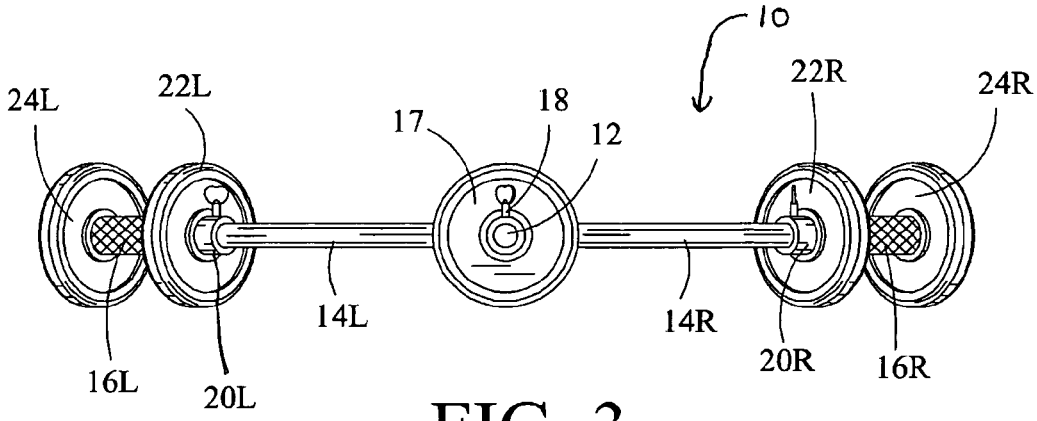
FIG. 3 is a top view of the preferred embodiment of the present invention.
Figure 4:
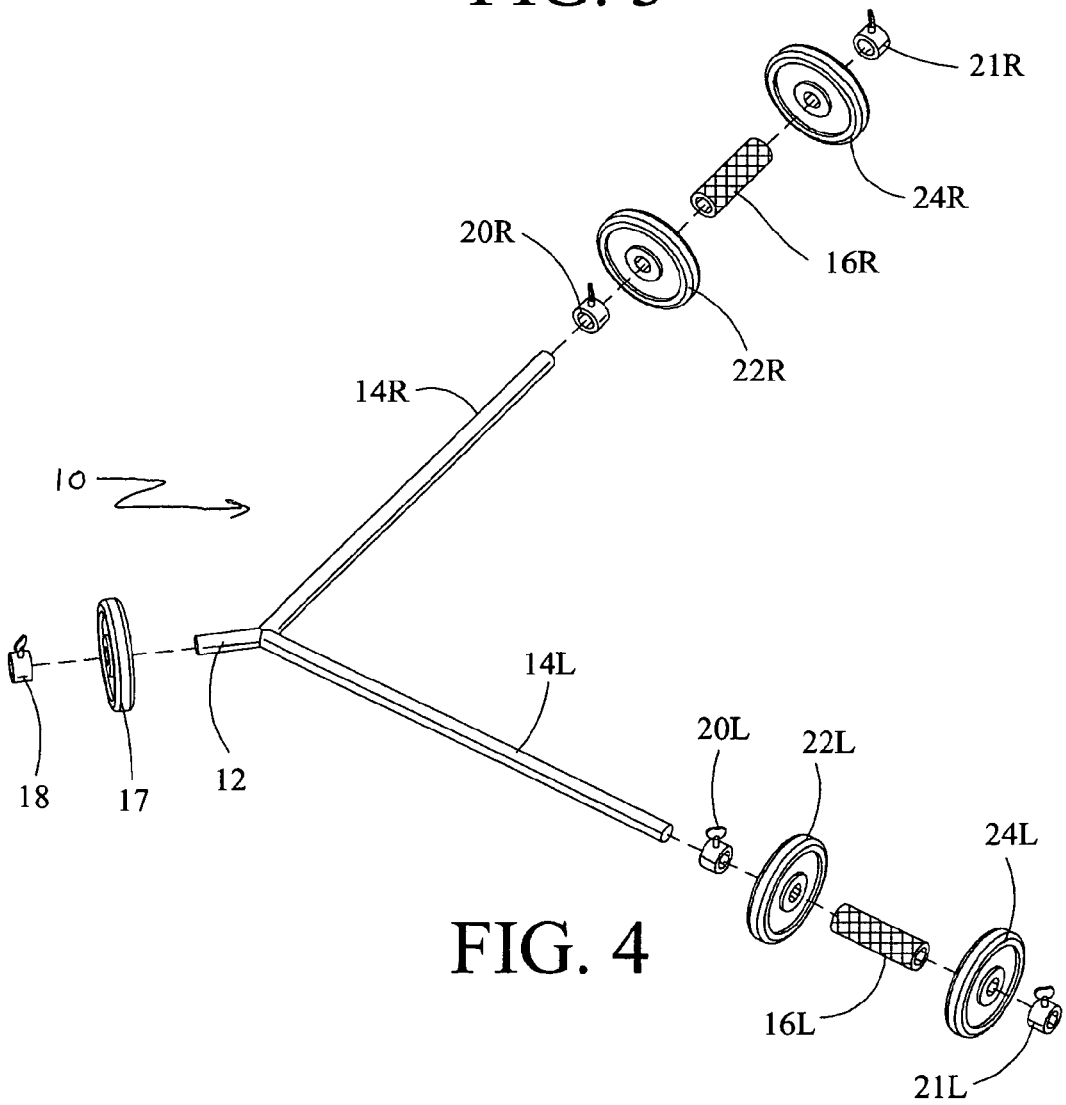
FIG. 4 is a front perspective view of the preferred embodiment of the present invention illustrating the different parts of the invention.

A preferred embodiment 10 of the exercise device of the present invention is illustrated in FIGS. 1 through 4. Preferred embodiment 10 comprises an apex post 12, two wing posts 14L and 14R, a pair of handle grip sleeves 16L and 16R, apex post weight 17 attached to the apex post and secured by an apex post weight collar 18, a pair of wing post center collars 20L and 20R attached to middle portion of the wing posts 14L and 14R, respectively, a pair of wing post end collars 21L and 21R attached to the ends of the wing posts 14L and 14R, respectively, wing post center weights 22L and 22R attached to the middle area of the wing posts 14L and 14R, respectively, and wing post end weights 24L and 24R attached to the bottom ends of the wing posts 14L and 14R.

Apex post 12 is a projecting post that extends in an outward direction and holds weight. Apex post 12 and wing posts 14L and 14R are fabricated from the same materials used to make standard or conventional barbells and dumbbells. Apex post 12 and wing posts 14L and 14R have a cylindrical cross section. Apex post 12 and wing posts 14L and 14R are permanently connected at a single point, using methods to connect the apex post 12 and the wing posts 14L and 14R that are known and used in the art. Wing posts 14L and 14R create a "V" shape, forming an angle more than 10° and less than 180°. The preferred angle is in the range of more than 45° up to about 90°.

Apex post weight collar 18, wing post center collars 20L and 20R, and wing post end collars 21L and 21R are standard dumbbell or barbell collars known and used throughout the weightlifting industry that attach or tighten around apex post 12 and wing posts 14L and 14R. Similarly, apex post weight 17, wing post center weights 22L and 22R and wing post end weights 24L and 24R are standard dumbbell and barbell weight plates or discs known and used in the industry, which slide onto apex post 12 and wing posts 14L and 14R.

Handle grip sleeves 16L and 16R can be fabricated from a plurality of materials to slide onto wing posts 14L and 14R. In other words, handle grip sleeves 16L and 16R have an inside diameter that is greater than the outside diameter of the wing posts 14L and 14R. Suitable materials can be metal, plastic, rubber, synthetic rubber, rubber compound or a combination of these materials. It should be appreciated that handle grip sleeves 16L and 16R have an outside diameter that is greater than the inside diameter of wing post center weights 22L and 22R and wing post end weights 24L and 24R. In addition, handle grip sleeves 16L and 16R can support both wing post center weights 22L and 22R and wing post end weights 24L and 24R without breaking or collapsing. While handle grip sleeves 16L and 16R have been described to slide onto wing posts 14L and 14R, they can also be carved, engraved, etched or otherwise permanently affixed in wing posts 14L and 14R, without departing from the spirit and scope of the present invention; provided, however, that weight plate collars or some other mechanism would need to be added in place of handle grip sleeves 16L and 16R to hold wing post center weights 22L and 22R and wing post end weights 24L and 24R in place to prevent them from smashing the weightlifter's hands.

Apex post weight 17 slides onto apex post 12 and is secured with apex post weight collar 18. Apex post weight 17 can consist of more than one weight plate or disc at the same or at varying weights. Apex post weight 17 can be heavier, lighter or the same weight as the weights on wing posts 14L and 14R depending on the particular use of preferred embodiment 10 by the weightlifter. The total weight of the apex post weight 17 can be heavier, lighter or equal to the total weight of the wing post center weights 22L and 22R and the wing post end weights 24L and 24R combined. Varying the apex post weight 17 in comparison to the weights on wing posts 14L and 14R changes the center of gravity or moment of inertia of preferred embodiment 10.

Wing post center collars 20L and 20R attach or tighten around the center portion of wing posts 14L and 14R. Wing post center collars 20L and 20R should be secured at an equal distance from the ends of the wing posts 14L and 14R. Wing post center weights 22L and 22R are slid onto wing posts 14L and 14R so that the weight plate or disc is flush with wing post center collars 20L and 20R. As can be readily appreciated, more than one weight plate or disc can be used for the wing post center weights 22L and 22R. Handle grip sleeves 16L and 16R are loaded flush with wing post center weights 22L and 22R on one end, and with wing post end weights 24L and 24R on the other end. As previously explained, handle grip sleeves 16L and 16R have an outside diameter that is greater than the inside diameter of the wing post center weights 22L and 22R and the wing post end weights 24L and 24R. More than one weight plate or disc can be used for the wing post end weights 24L and 24R as well. Wing post end weights 24L and 24R are held in place by handle grip sleeves 16L and 16R on one end and by wing post end collars 21L and 21R on the other. If loading more than one weight plate or disc onto wing posts 14L and 14R, it may be desirable to use the smaller outside circumference weight plates or discs as the wing post center weights 22L and 22R and the larger outside circumference weight plates or discs as the wing post end weights 24L and 24R, although it is not required.

Wing post center collars 20L and 20R, wing post center weights 22L and 22R, handle grip sleeves 16L and 16R, wing post end weights 24L and 24R and wing post end collars 21L and 21R can all be adjusted up or down the length of the wing posts 14L and 14R to suit the individual's need, desire and comfort.

Figure 5:
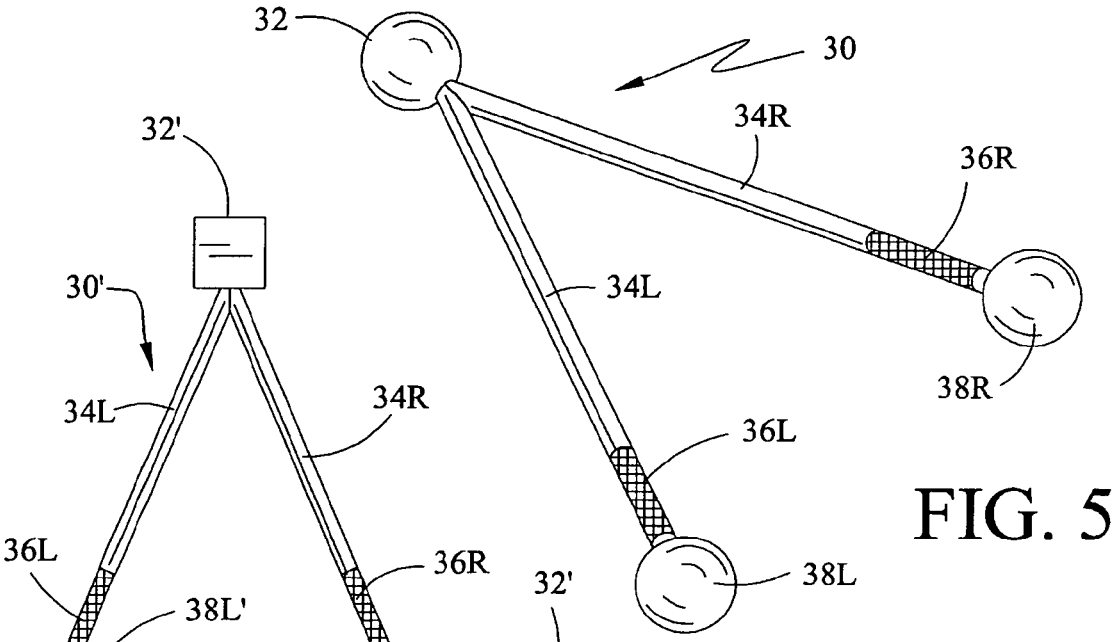
FIG. 5 is a front perspective view of an alternative embodiment of the present invention.

An alternative embodiment 30 of the present invention is depicted in FIG. 5. Alternative embodiment 30 comprises a spherically weighted apex post 32, a pair of wing posts 34L and 34R, a pair of handle grips 36L and 36R affixed to wing posts 34L and 34R, respectively, and wing post weights 38L and 38R permanently attached to the bottom end of wing posts 34L and 34R, respectively.

Wing posts 34L and 34R are fabricated from the same materials used to make standard or conventional barbells and dumbbells. Apex post 32 and wing posts 34L and 34R are permanently joined at the point where wing posts 34L and 34R meet to form a "V" using methods to connect the apex post 32 with the wing posts 34L and 34R that are known and used in the art. Wing posts 34L and 34R form an angle more than 10° and less than 180°. The preferred angle is in the range of more than 45° up to about 90°. The apex post 32 and wing post weights 38L and 38R can be ball-shaped, cubed-shaped, hexagon-shaped, or any other geometric shape. Wing post weights 38L and 38R are of equal weight, while apex post 32 can be the same or different weight from wing post weights 38L and 38R. Handle grips 36L and 36R are carved, etched, engraved or otherwise permanently set into wing posts 34L and 34R. While handle grips 36L and 36R have been described as permanently set into wing posts 34L and 34R, they can also be separately manufactured with metal, plastic, rubber, synthetic rubber, rubber compound, or a mix of these materials to fit snugly onto wing posts 34L and 34R without departing from the spirit and scope of the present invention.

The total weight of the apex post 32 can be heavier, lighter or equal to the total weight of the wing post weights 38L and 38R. Differing weight of the apex post 32 in comparison to the wing post weights 38L and 38R changes the center of gravity or moment of inertia of alternative embodiment 30.

Figure 6:
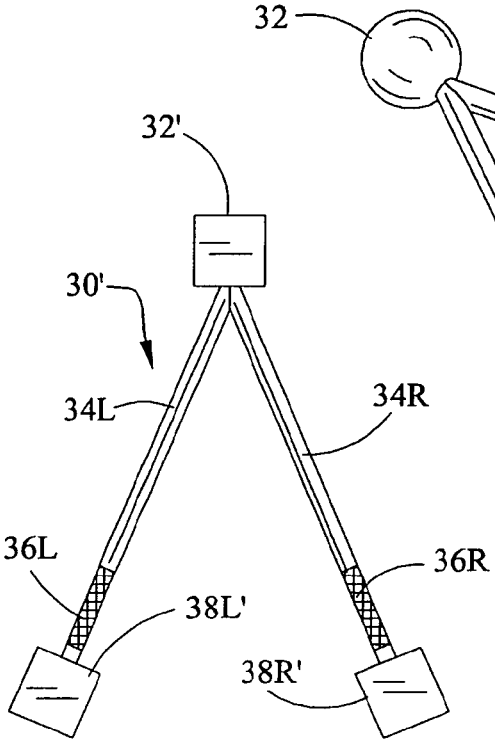
FIG. 6 is a front view of an alternative embodiment of the present invention.
Figure 7:
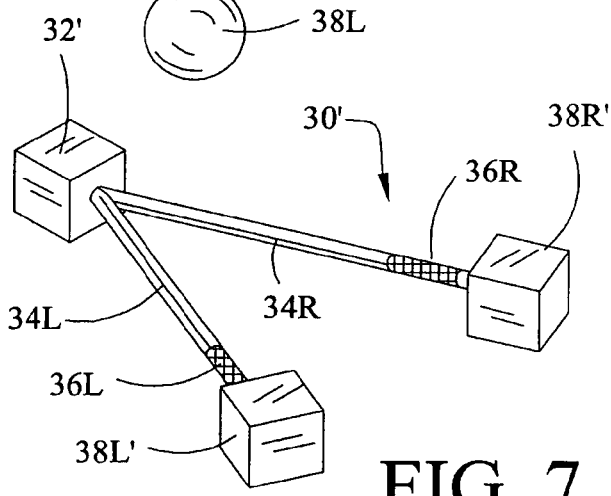
FIG. 7 is a front perspective view of an alternative embodiment of the present invention.

FIGS. 6 and 7 depict an alternative embodiment 30' of the device wherein the apex post 32' and wing post weights 38L' and 38R' are cubed shaped. Alternative embodiment 30' is the same in all other respects to alternative embodiment 30.

Figure 8:
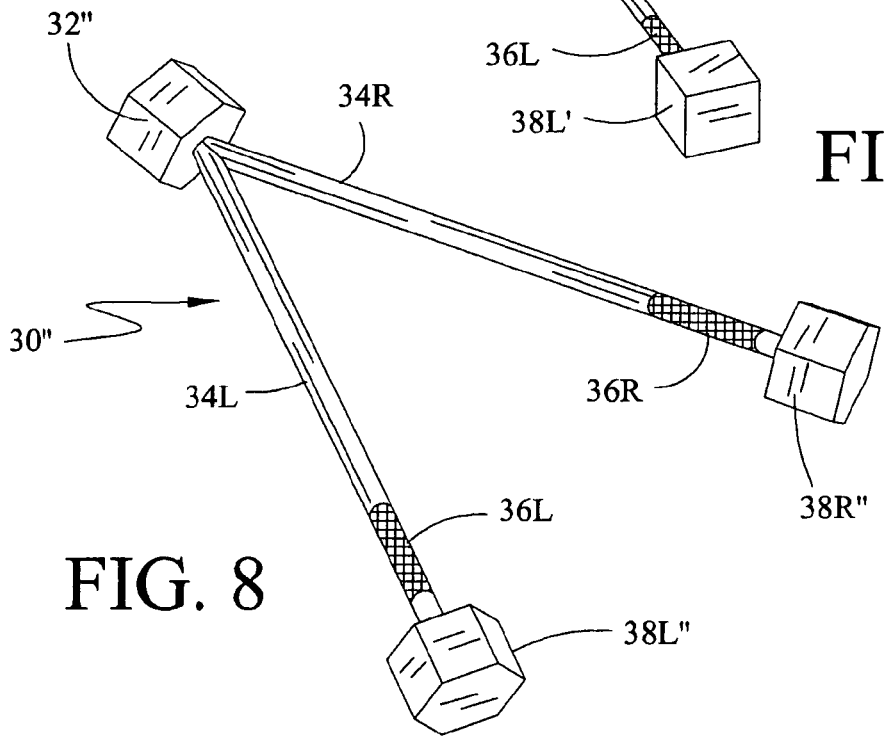
FIG. 8 is a front perspective view of an alternative embodiment of the present invention.

FIG. 8 depicts a further alternative embodiment 30" of the device of the present invention, wherein the apex post 32" and wing post weights 38L" and 38R" are hexagon-shaped. Alternative embodiment 30" is the same in all other respects to alternative embodiments 30 and 30'. While the apex post 32, 32' and 32" and wing post weights 38L, 38L' and 38L" and 38R, 38R' and 38R" taking the form of balls, cubes and hexagons have been illustrated, they can equally take the form of octagons, pentagons, triangles, pyramids or other geometric shapes.

The method of the present invention begins with the weightlifter standing between the wing posts 14L and 14R of preferred embodiment 10, with the apex post 12 pointing forward or in the direction of the weightlifter's feet. After bending down to grip preferred embodiment 10 by handle grip sleeves 16L and 16R, the weightlifter stands with arms to the side and preferred embodiment 10 wrapped around the hips and lower stomach area. The weightlifter is now in the start position. At the start position, the weightlifter extends his or her arms outward and forward without bending the elbows. When the weightlifter raises preferred embodiment 10 above his or her head, the weightlifter then lowers preferred embodiment 10 back to the start position, keeping his or her arms outward with elbows straight. The weightlifter repeats this method as desired.

Although the method has been described using preferred embodiment 10, the method can also be performed using alternative embodiments 30, 30' and 30". Using alternative embodiments 30, 30' and 30", the weightlifter stands between wing posts 34L and 34R with apex post 32, 32' or 32" pointing forward or in the direction of the weightlifter's feet. After bending down to grip alternative embodiment 30, 30' or 30" by handle grips 36L and 36R, the weightlifter stands with arms to the side and alternative embodiment 30, 30' or 30" wrapped around the hips and lower stomach area. The weightlifter is now in the start position. At the start position, the weightlifter extends his or her arms outward and forward without bending the elbows. When the weightlifter raises alternative embodiment 30, 30' or 30" above his or her head, the weightlifter then lowers alternative embodiment 30, 30' or 30" back to the start position, keeping his or her arms outward with elbows straight. The weightlifter repeats this method as desired.

An alternative method of the invention can also be performed using preferred embodiment 10 or alternative embodiments 30, 30' and 30". In the alternative method, the weightlifter steps inside wing posts 14L and 14R of preferred embodiment 10 (or wing posts 34L and 34R of alternative embodiments 30, 30' and 30") with apex post 12 (or apex post 32, 32' or 32" of alternative embodiments 30, 30' and 30") pointed toward the rear or opposite the direction of the weightlifter's feet. The weightlifter then bends forward to grip handle grip sleeves 16L and 16R (or handle grips 36L and 36R of alternative embodiments 30, 30' and 30"). The weightlifter then stands with arms to the side and preferred embodiment 10 (or alternative embodiments 30, 30' or 30") wrapped around his or her lower back, holding it in place like a belt. The weightlifter then performs a squat until his or her thighs are parallel with the ground, and then stands up. This alternative method can be repeated as desired by the weightlifter.

Weights can be added or removed from preferred embodiment 10 to suit the weightlifters particular strengths and exercises. Similarly, heavier or lighter alternative embodiments 30, 30' or 30" may be used to perform the methods described above.

The above described methods can be modified to suit the weightlifter's individual desires. Other exercises that can be performed using conventional dumbbells and barbells are possible and contemplated by the inventor using the exercise device described herein.

Thus, as can be readily appreciated, the method and exercise device of the present invention can substantially advance the efficient weight training of the upper and lower body that conventional dumbbells and barbells fail to achieve. In particular, because the apex of the exercise device of the present invention contains a projecting post that holds weight, the exercise device allows the weightlifter to balance and counter balance the weights on the wings of the device and move the center of gravity around for greater comfort and substantially more efficient training of the muscles. Those skilled in these arts understand that the exercise device does not constrict the range of motion of the weightlifter when performing the methods of the present invention as compared to using conventional dumbbells and barbells and universal pulley machines. Additionally, the device is not bulky and does not require the use of cables, levers and pulleys typically required with universal weight machines.

Of course, it is possible to substitute equivalents for the embodiments discussed above. For example, instead of a solid exercise bar, one can use a hollow exercise bar. Instead of a bar with a cylindrical cross section as customarily used in the weightlifting industry, you can use a bar with an oval, hexagonal or other polygonal cross section. Instead of using standard weight plates and discs, one can use custom weight plates and discs as long as the inside diameter of the custom weight plates and discs is larger than the outside diameter of the apex post 12 and wing posts 14L and 14R, and smaller than the outside diameter of the handle grip sleeves 16L and 16R.

There are also alternate embodiments that can take the place of the embodiments discussed above. For example, the apex can contain a swivel mechanism that allows the angle formed by the wing posts to be adjustable. As another example, the device can be made to accept Olympic weight plates, discs and collars rather than standard weight plates, discs and collars. The weights can also be loosely held in place instead of being flush with the collars and handle grip sleeves to allow the weights to slide around during use. There can also be other ways to hold the weights in place. For example, the collars can be replaced with weights that contain a tightening mechanism that holds the weights in place on the apex post 12 and wing posts 14L and 14R.

The following alternate embodiments can also take the place of embodiments discussed above: Wing post center weights 22L and 22R can be removed from the wing posts 14L and 14R so that the only weights on the wing posts 14L and 14R are wing post end weights 24L and 24R. Similarly, wing post end weights 24L and 24R can be removed so that the only weights on the wing posts 14L and 14R are wing post center weights 22L and 22R. Parts from preferred embodiment 10 can also be interchanged with parts from alternative embodiment 30, 30' and 30". For example, apex post 12 of preferred embodiment 10 can be permanently set with weight similar to apex posts 32, 32' and 32" of alternative embodiments 30, 30' and 30" while keeping the remaining parts of preferred embodiment 10 the same.

Likewise, apex posts 32, 32' and 32" of alternative embodiments 30, 30', and 30" can be replaced by apex post 12, apex post weight 17 and apex post weight collar 18 while keeping the remaining parts of alternative embodiments 30, 30' and 30" the same in all other respects.

Although the description of the various embodiments of the present invention have been set forth with specificity, it is contemplated that modifications could be made without departing from the spirit and scope of the present invention. Accordingly, the scope of the invention should be determined by the appended claims and their legal equivalents, rather than with reference to any particular example, embodiment or illustration.

The embodiments of the invention in which an exclusive property or privilege is claimed are defined as follows:

1. An exercise device for weightlifting comprising:

a weightlifting bar having two wings permanently joined by one ends thereof coming to a single point at an apex of a "V" shape formed by the two wings, said apex being provided with an apex post and said two wings having outer ends thereof provided with two wing posts, respectively;

said wing posts formed on the outer ends of the wings being capable of accepting wing post weights thereon;

said apex post being formed by a projecting post that extends in an outward direction from the single point at the apex of the V shape and is capable of accepting an apex weight thereon, thereby allowing the weightlifter to balance the wing post weights with each other and counter balance the apex weight with the weight on the wings for various exercises.

2. The device of claim 1 wherein said wing posts form an angle between about 45 degrees and up to 90 degrees.

3. The device of claim 1 wherein an apex post collar holds the apex post weight in place.

4. The device of claim 1 wherein wing post center collars hold the wing post weights in place.

5. The device of claim 1 wherein wing post end collars hold the wing post weights in place.

6. The device of claim 1 having a pair of handle grips with spacer sleeves on the outer ends of the wing posts, wherein said wing posts have a tubular shape with an outside diameter, and said wing post weights have a center bore with an inside diameter, said handle grips spacer sleeves having an aperture with an inside diameter larger than the outside diameter of the wing posts so that they can be slid onto the wing posts, and an outside diameter greater than the inside diameter of the wing post weights to hold the weights in place.

7. The device of claim 1 having a pair of handle grips, said handle grips being selected from a group consisting of plastic, metal, rubber, synthetic rubber, and rubber compound.

8. The device of claim 1 wherein said apex post and wing posts have solid single weights mounted on their ends, said weights having a predetermined weight and comprise a geometric shape.

9. A weight training method wherein a weightlifter, grasping the exercise device of claim 1 with two hands whereby said wing posts of the exercise device wraps around the stomach and hips and said apex post points in the direction of the weightlifter's feet, then extending arms outward and forward without bending the elbows until said exercise device is overhead, and then lowering said exercise device back down to the stomach and hips.

10. A weight training method wherein a weightlifter, grasping the exercise device of claim 1 with two hands whereby said wing posts of the exercise device wraps around the lower back and hips and said apex post points opposite the direction of the weightlifter's feet, then performing a squat until the weightlifter's thighs are parallel with the ground, and then standing back up.

* * * * *